United States Patent [19]

Brutsman

[11] Patent Number: 4,552,061

[45] Date of Patent: Nov. 12, 1985

[54] TRASH COMPACTOR SYSTEM

[75] Inventor: James W. Brutsman, Cheyenne, Wyo.

[73] Assignee: AMF Incorporated, White Plains, N.Y.

[21] Appl. No.: 538,704

[22] Filed: Oct. 3, 1983

[51] Int. Cl.[4] ..... B30B 15/06

[52] U.S. Cl. ..... 100/53; 100/229 A; 100/256; 100/295

[58] Field of Search ..... 100/53, 52, 295, 229 A, 100/256, 278, 288

[56] References Cited

U.S. PATENT DOCUMENTS

| | | | |
|---|---|---|---|
| 3,859,911 | 1/1975 | Karls et al. | 100/215 |
| 4,005,648 | 2/1977 | Edwards | 100/229 A X |
| 4,044,664 | 8/1977 | Budoff | 100/229 A X |
| 4,073,227 | 2/1978 | Moriconi | 100/288 X |
| 4,147,100 | 4/1979 | Dykstra | 100/229 A X |

*Primary Examiner*—Billy J. Wilhite

*Attorney, Agent, or Firm*—David E. Dougherty; John H. Gallagher

[57] ABSTRACT

A trash compactor system which includes a trash compactor unit, a compaction receptacle and a trash deposit door disposed above the receptacle to enable trash to be desposited in the system. The door is automatically opened when a person approaches the compactor to deposit waste material therein by pressure being applied to a mat switch positioned on the floor adjacent the compactor. The compactor member compacts waste in the receptacle by passing through a compaction cycle. When pressure is removed from the switch, a predetermined time period has elapsed and the waste deposit door is closed, the compaction cycle is initiated. At this time, mechanical locks within the compactor are forced against the door, preventing the door from being opened during the compaction cycle. The mechanical locks are released after the compaction cycle is completed.

7 Claims, 4 Drawing Figures

TRASH COMPACTOR SYSTEM

BACKGROUND OF THE INVENTION

It has become commonplace in homes, commercial buildings and industrial establishments to compact trash and waste for conserving space and in retail business establishments for saving labor costs. For example, commercial establishments, such as fast food restaurants and the like, have peak hours when there is a need to dispose of large amounts of highly compactable waste such as disposable cups, dishes, eating utensils and food. When such trash or waste is not compacted, large disposal areas or frequent waste removal is required, particularly at a time when personnel are the busiest.

Trash or waste containers are typically made in standard sizes for use in the waste bins of commercial establishments. Such waste bins are normally provided at their lower portions with a door or drawer for access to remove or replace the containers when they are full. At their upper ends, the containers usually have an opening for depositing trash. The opening can be provided with a hinged closure member, which, if manually opened by the user, often causes problems. In particular, a user or customer carrying a full tray of trash to be disposed of is required to manually push open the closure member or door while holding the trash and, in so doing, runs the risk of dropping trash on the floor which is clearly undesirable and can also create a hazard.

Typical of prior art waste or trash compactors is the compactor disclosed in U.S. Pat. No. 3,901,139. Each time the door is opened to introduce trash, the time interval is registered. When the total time of successive openings exceeds a predetermined setting, the compactor member is operated through one cycle. Although the compactor is not operated each time the door is opened, it can operate while the door is open. A safety shield is provided inside the compactor to prevent the hand of the user from moving into the path of the compactor member, but the possibility of accidents occuring, for example, when the shield is not properly positioned, still remain.

Other patents of interest which relate to trash compactors include U.S. Pat. Nos. 3,155,314 and 3,081,937 to Kreider. These patents describe trash disposal systems which use pneumatic control mechanisms to open and close the access members to the trash disposal system. U.S. Pat. No. 3,003,317 to Schroeder et al and U.S. Pat. No. 2,843,376 to Osuch et al disclose systems using sensors to open and close trash access doors. U.S. Pat. Nos. 3,212,433 and 3,212,432 to Raab disclose an electric eye and time relay system to activate a compacting ram after sufficient material has been accumulated for baling.

U.S. Pat. No. 3,905,289 to Engebretsen discloses a compactor that includes a compaction receptacle and a separate compartment disposed above the receptacle to permit materials to be deposited in the compactor without moving the entire receptacle out of the compactor housing. U.S. Pat. No. 4,044,642 to Budoff discloses a system for handling of solid waste which includes a door that provides access to a compactor unit, the door being automatically opened or closed in response to the presence or absence of a motor vehicle.

What is desired is to provide a waste compactor suitable for installation in conventional existing waste containers, particularly in commercial establishments, wherein the trash access door opens automatically as the customer or user approaches, thus enabling the user to have both hands free to dispose of the waste products. For safety reasons, it is desired, on the one hand, that the compactor member be inoperative as long as the trash access door is open, and on the other hand, that the trash access door be securely locked once the compaction cycle is initiated to prevent accidents from occurring. In addition, it is desirable to provide a self-contained trash compactor unit that can easily fit or slide into standard trash containers of existing size and configuration so that the unit can be retrofitted and removed from the waste systems on site.

SUMMARY OF THE INVENTION

The present invention relates to a trash disposal system which includes a trash compactor, a compaction receptacle and trash deposit door disposed above the receptacle to permit the waste materials to be deposited therein. The deposit door is automatically opened when the user, carrying trash material, approaches the compactor, and is automatically closed when the user leaves the area of the compactor.

In one embodiment, the automatic opening of the door is initiated by a sensor, for example, when pressure is applied to a mat switch placed on the ground in front of the compactor, the same mat switch also being provided to initiate the activation of a timer. After a predetermined time period, the compaction cycle is activated unless pressure is still applied to the mat switch or the trash deposit door is open. As a compacting ram starts its travel from an idle or home position through a compaction cycle, a ram plate means associated with the compactor ram causes a mechanical trash deposit door locking means to position itself to secure the trash door until the compaction cycle is completed. The ram continues its travel through its compaction cycle until the ram motor stalls out against compacted trash. When the motor stalls, it is caused to reverse direction so that the ram is returned to its home position. As the ram returns to its home position, the ram plate means causes the trash deposit door locking means to be released. Means are also provided to allow the compaction cycle to be initiated whenever desired by supplying an electrical signal to the ram motor directly.

In another embodiment, the present invention provides a compactor which is adapted to be used in waste containers now presently utilized by many commercial establishments. The compactor unit can be made to slide or fit into standard trash receptacle by providing a suitable frame means therein for easy installation and removal of the compactor unit on site where the waste containers are located.

In another embodiment of the invention, by allowing the trash deposit door to be automatically opened when a customer approaches the compactor, the customer has both hands free to dispose of waste paper products thereby reducing the possibility of some of the waste products falling on the ground as they are deposited. Improved safety means are provided in that the compaction cycle cannot be initiated until the trash deposit door is closed. Once closed, the trash deposit door may be locked until the cycle is completed.

BRIEF DESCRIPTION OF THE DRAWINGS

The foregoing aspects and other features of the invention are explained and the following description is taken in conjunction with the accompanying drawings wherein.

DETAILED DESCRIPTION OF THE PREFERRED EMBODIMENTS

Figure 1:
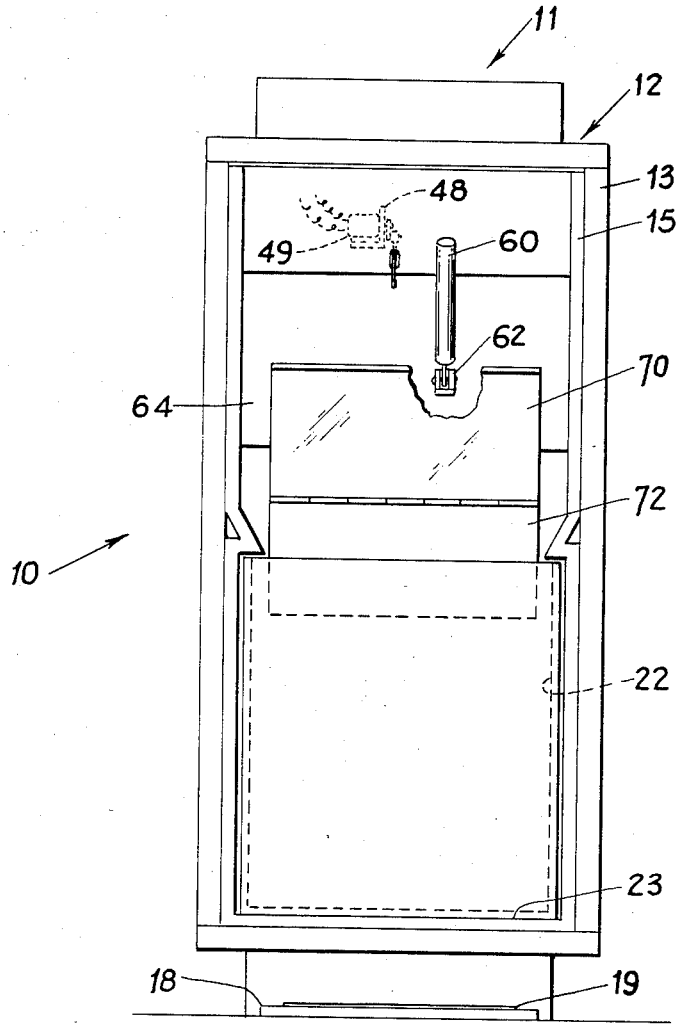
FIG. 1 is an elevation view of the compactor system of the present invention.

FIG. 1 is a front elevation view of the trash compactor system 10 of the present invention. The system described herein includes a receptacle basket to retain the trash, a door through which trash can be deposited in the receptacle by a user and a compactor unit. Although the system can be used in any suitable environment, it is described herein, for purposes of clarity, in the environment of existing standard waste containers such as those used in fast food restaurants and like settings. These standard commercially used containers normally have an outer plastic or wood decorative cabinet and a trash access door that can be opened to remove the trash receptacle so that the trash can be emptied.

In accordance with the teachings of the present invention, the compactor unit is installed in waste container 12. The installation can be accomplished in any suitable manner. For instance, as shown in the figures, compactor 16 can be located on its own frame means 17 which is sized to fit into the top of waste container frame 13 and supported thereon by any suitable means such as frame means or rails 15 which may be mounted on or made part of the receptacle frame 13. The compactor unit can be placed in or removed from the waste container, on site, by sliding it through door 20 which may be temporarily removed or down onto the receptacle frame after removing the top portion 11 of the cabinet. The door or top is replaced after the compactor unit is in place and the compactor frame may be fastened to the waste container frame, if desired.

The waste disposal system including the compactor 16 is plugged in, such as to a standard electrical outlet, to become operational. A mat 18, having a switch 19 incorporated therein, is placed on the ground or floor adjacent the waste container so that the system can be automatically activated as a user stands next to the trash door 20 to deposit waste material therein. The trash door 20 is located in any convenient area of the waste container such as in the upper portion of trash container 12 as illustrated.

Figure 2:
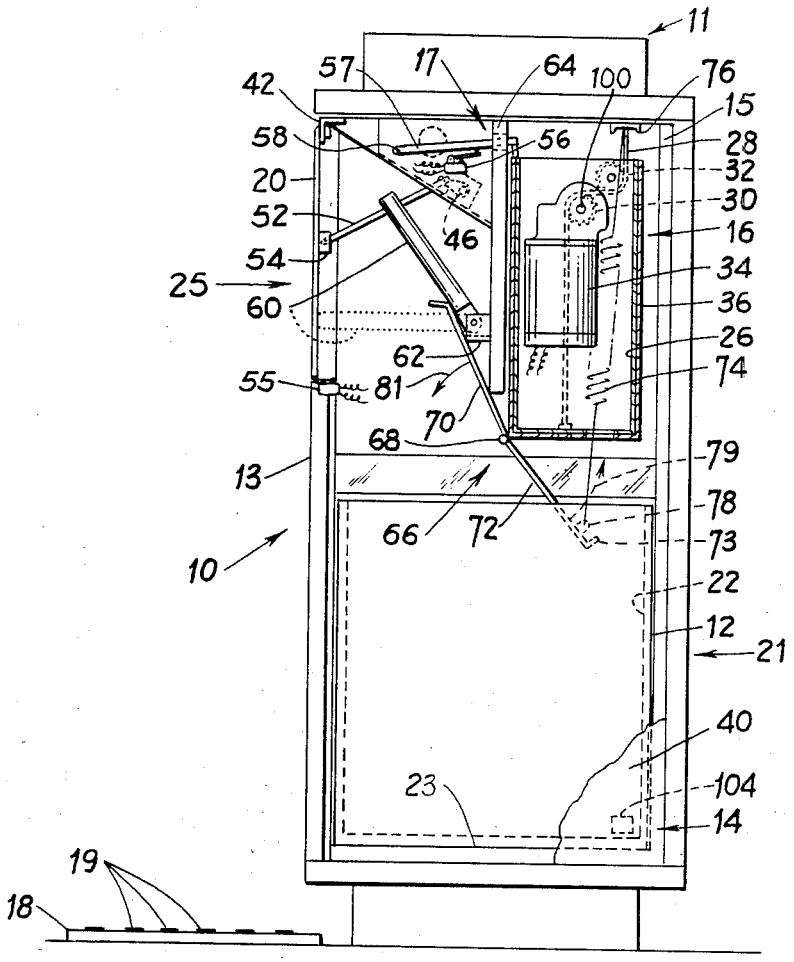
FIG. 2 is a side view of the compactor system shown with the outside cover removed.
Figure 3:
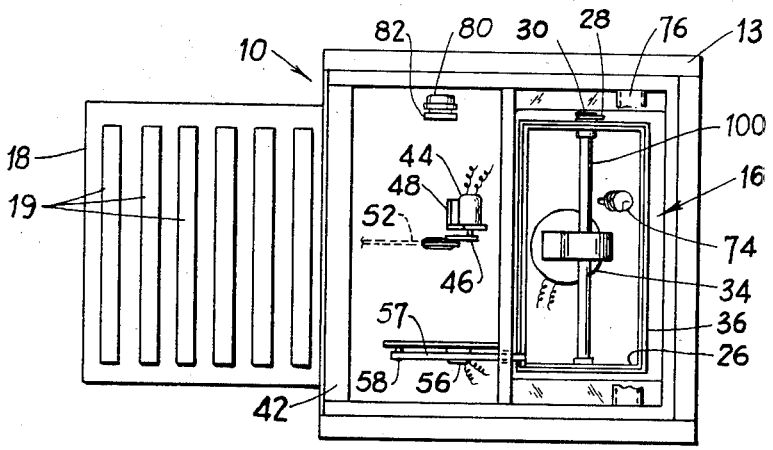
FIG. 3 is a plan view of the compactor system shown in FIGS. 1 and 2.

FIGS. 2 and 3 show in more detail the components of the present invention. In particular, the waste container 12 comprises a frame member 13 having lower and upper housing portions 21 and 25, respectively. The lower portion 21 contains any suitable receptacle 22, such as a plastic basket, for receiving trash material to be compacted. Receptacle 22 is supported on member 23. Upper portion 25 contains the system control electronics and the compacting ram 26.

Ram 26 passes through an operating cycle, beginning at an idle or home position, (shown in FIG. 2), to compact trash. The compacting ram 26 is adapted to travel from its home position in a forward (downward) direction on a steel chain 28 fixedly attached at one end to support member 76 and at its other end to the lower portion of frame means 17 or the midsection of the receptacle frame 13 via sprockets 30 and 32 and then reverse itself and travel in a return (upward) direction to return to its home position during a cycle. When the ram reaches its home position in concluding its cycle, it forces the right-hand end of trip member 57 up in the counter clockwise direction. Member 57 rotates about fixed pivot 58. As member 57 is so rotated, it is lifted off of switch 56 thereby changing the state of the switch to indicate to the control circuitry that the home position has been reached. A ram motor 34 is provided to drive the ram 26 by rotating the shaft 100 and sprocket 30 moving the ram 26 along the chain 28 in both directions, as will be explained in more detail hereinafter with reference to FIG. 4.

A protective ram cover 36 may be used over ram 26, the ram cover 36 being removable from the ram 26 to be cleaned when necessary. The compactor unit shown in the figures is equipped with a trash access door 40 which is hinged (not shown) to the waste container and contains a switch 104, as illustrated. The main purpose of this door is to gain access to the trash receptacle 22 to empty it, to replace it or place a new liner (not shown) in it. Switch 104 indicates to the electrical circuitry if the trash access door is opened or closed.

The trash deposit door 20 can be hinged to mounting 42, as illustrated in FIGS. 2 and 3, to enable it to swing counterclockwise, via motor 44, to be opened for the deposit of trash and then to swing clockwise, via gravity, to close when the trash has been deposited and the user steps off the mat 18. A door motor 44, FIG. 3, having a motor shaft 46 is mounted within the compactor unit by a motor bracket 48. The end of motor linkage arm 52 is connected to a door bracket 54 mounted to the inside of trash deposit door 20. Motor 44, when the door 20 is to be opened, turns shaft 46 in the clockwise direction (FIG. 2) thereby drawing arm 52 up to the left causing the door 20 to swing open into the cabinet. Door 20 cooperates with switch 55 to indicate when the door is open and closed. The state of switch 55 indicates to the control circuitry when the door may be appropriately closed by gravity. This latter action is accomplished by any suitable mechanism acting on motor shaft 46 that releases it from being fixedly engaged with arm 52. For example, a simple clutch could carry out this function. When the clutch is disengaged, the door and arm would be free to move, through the force of gravity, back to the position whereby the door is in a closed condition.

One important feature of the disposal system is directed towards the safety of the user. Trash deposit door 20 is prevented from opening when the compactor unit is being cycled. This is accomplished by a locking means physically barring the door 20 from being opened by the user. Any suitable locking means can be used for this purpose such as a locking member, or members, which positively hold the door 20 shut.

FIG. 2 illustrates one suitable mechanism to carry out the locking function. A trash door lock 60 (or multiple locks, optionally) is pivotally mounted on a bracket 62 which, in turn, is mounted to a vertical frame member 64 on the compactor unit. A ram plate 66 comprises two integral elongated members, 70 and 72, and pivotally attached to the ram cover 36 at a pivot point 68. One elongated member 70 is operatively engageable with lock 60 while the other elongated member 72 extends below the bottom of the ram cover 36. Member 72 includes a lip, or gripping portion 73, at its free end. It should be noted that the pivot point 68 is connected to one end of the ram cover 36 as illustrated. A cable and extension spring 74 has one end mounted to support member 76 and its other end connected to a bracket 78 mounted on the ram plate portion 72.

The door locking mechanism operates to keep trash door lock 60 in the position shown in solid lines in FIG. 2 when the compactor ram is in its home position, also as shown in FIG. 2, and to place the lock 60 in the position shown in dotted lines in FIG. 2 when the compactor is cycling. Elongated member 70 is free to pivot at point 68, its position being dictated by the position of ram 26 and angle of elongated member 72. When member 70 is in the position shown in solid lines in FIG. 2, it operatively engages with lock 60 to keep the lock up and away from door 20 thereby enabling the door to be opened by a user stepping on mat 18.

When the ram 26 begins its compaction cycle, it drops from its home position and moves downward towards the trash contained in receptacle 22. The ram means brings ram plate 66 with it as it cycles because these members are attached to the ram means (ram cover) at pivot point 68. Thus, as the ram continues to drop, the upper portion of ram plate 66 which is elongated member 70 drops away from lock 60 enabling lock 60 to pivot, via gravity, about its pivot on bracket 62 in the counterclockwise direction until it reaches the dotted line position shown in FIG. 2. The lock, in this embodiment, cannot drop any further than this position due to it finally resting against a bottom horizontal plate section (not shown) on bracket 62. It is in this position that lock 60 bars door 20 from being opened from outside the waste disposal system by a user.

The locking mechanism is designed to assure a quick locking of door 60 as the ram begins to drop in its compaction cycle. When the ram starts its cycle, it brings pivot 68 down with it, but the tip 73 of elongated member 72 is biased towards the top of the waste disposal system by spring 74. As a result, the ram plate, and particularly elongated member 72 is rotated in the counterclockwise direction. As such rotation occurs, elongated member 70, which is connected to member 72 through pivot 68, is also rotated in the counter clockwise direction. This mechanism thereby moves elongated member 70 away from lock 60 much more quickly at the beginning of the ram's cycle than would be the case if the downward travel of the ram solely were relied on to activate the lock 60.

At some point in the ram's cycle, as will be explained more fully below, the ram reaches the limit of its downward travel, reverses itself and is returned to its home position. As the ram returns to its home position, elongated member 70 engages the underside of lock 60 and forces it in the clockwise direction to unlock door 20. The unlocking process occurs at the very end of the ram's cycle due to the action of spring 74 on the elongated members 70 and 74, but acting in reverse manner as that described at the beginning of the ram cycle.

The operation of the compactor unit is as follows. Compactor 16 is shown in FIG. 2 in its idle or home position. When a user stands on mat switch 18, a switch 19 incorporated therein is closed causing trash deposit door 20 to be automatically opened by the door motor 44. Closing of the mat switch 19 also activates a compactor timer 80 (described in more detail hereinafter with reference to FIG. 4). When the timer 80 has completed its timing cycle, the trash deposit door 20 is closed as determined by switch 55 and the pressure on mat switch 19 being removed. At this point, the ram can start its compaction cycle.

The timing cycle can be of any suitable duration and can be triggered by any suitable event. For instance, it may be determined by a mere passage of time from the last compaction cycle. Alternatively, it may be the cumulative amount of time that the door 20 is open (a user is on the mat), the number of times the door 20 has opened and closed, or a combination of these two occurrences. For the purposes of simplicity in this description, it is assumed that the timer determines that a user has been off the mat for approximately 15 seconds before the timer times out and the next compaction cycle can begin. As the cycle begins, the ram motor 34 moves the ram in a downward direction which drops the trash door lock 60 in place, as shown in FIG. 2 in phantom, to prevent the door from opening until the compacting cycle is completed. When the ram 26 reverses direction and goes in the upward direction, the trash door lock 60 moves out of the way of the door 20 and the compactor is brought back to its original or home position.

Although the operation of the compactor unit may be carried so that the door 20 is locked by locking device 60 until the ram 26 passes through its full and complete cycle of compaction, it need not necessarily be programmed only in this manner. For instance, the circuitry may be altered in such a manner that the compaction cycle is interrupted and the ram returned to its home position before complete compaction occurs. This may be desirable in situations in which one would want user access to the deposit door 20 to be a higher priority than the compaction cycle. In this alternative manner of operation, even though the compactor ram 26 could continue further downward in the compaction process, the event of a user stepping on the mat 18 before this occurs would reverse the ram and bring it quickly back to its home position so that the user would have more immediate access to the system to deposit trash. In this type of operation, however, it may also be desirable to program the operation, and make appropriate changes in the circuitry, to assure that a full compaction cycle occurred regardless of another user stepping on the mat 18 after a certain amount of time or after a certain amount of openings of door 20.

The trash deposit door 20 automatically opens when pressure is applied to the mat switch 19 on the floor in front of the compactor unit. Mat switches of the type utilized herein are commonly available and, in essence, are pressure-sensitive switches which close an electrical contact when pressure is applied thereto. Such mat switches are generally operable if the user steps anywhere on the mat. Other types of user-activated switches, as well as other devices that function in a similar manner, can be used with the system disclosed herein and it is not required that a pressure-sensitive mat switch be used. Any device that "senses" that a user wants to deposit trash to the circuitry can be employed; for instance, a typical "electric eye" device can be provided instead of mat 18.

Closure of switch 19 energizes the door motor 44 and also activates the timer unit 80. When the timer times out after a predetermined time period, a timer switch is closed and the compaction cycle is initiated. A cycle inhibit or disable system is provided such that the compaction cycle is not initiated unless pressure is removed from mat switch 19 and trash deposit door 20 is closed. In other words, this provides a protection system to minimize the possibility that a customer could be injured by the compactor unit.

As ram motor 34 is energized at the start of the compaction cycle, the ram 26 starts to move downward by rotating shaft 100 and sprocket 30 in a clockwise direction (see FIG. 2) which moves the ram 26 along the chain 28 which is fixedly attached at both ends to the frame means 17 and member 72 is rotated counterclockwise by virtue of the movement of ram 26 and ram cover 36 and by the operation of the cable and extension spring 74. As member 72 is rotated in the direction of arrow 79, in a more horizontal position about pivot point 68, member 70 is also rotated in the direction of arrow 81. This forces the mechanical trash deposit door lock 60 into its horizontal locking position. One end of the mechanical lock 60 abuts against door 20 preventing the door 20 from being moved inwardly as the ram passes through its compaction cycle. Door locks 60 remain in position to secure the trash door 20 until the compaction cycle is completed. When members 70 and 72 move into a more horizontal position, lip portion 73 is forced against the side of ram cover 36. Eventually ram motor 34 stalls out against compacted refuse in the container basket 22. At this point, a switch in ram motor 34 is tripped, thereby reversing the direction of motor 34 so that ram 26 and ram cover 36 returns to its home position. The ram 36 is moved in an upward direction on the same steel chain 28 and gearing arrangement described above.

The ram 36 may be returned to its home position with the aid of a counterbalance (not shown).

The system also includes the feature of having the compaction cycle start whenever desired. This override feature can be accomplished by using an automatic/-manual key switch 88. The key switch 88 works by supplying an electrical signal to the ram motor 34 directly, thus bypassing the electrical signal applied by the timer switch 82.

Figure 4:
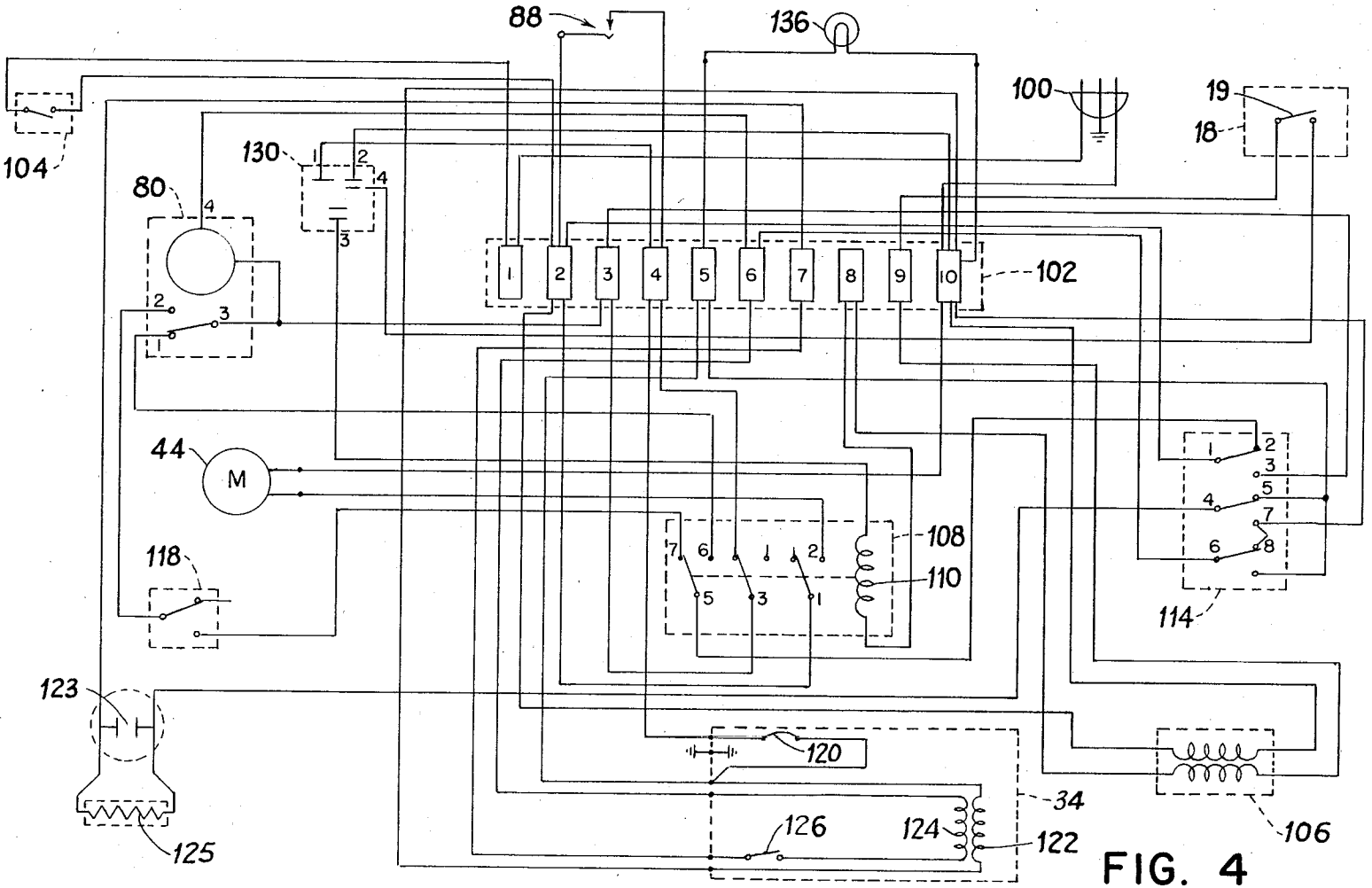
FIG. 4 is a schematic of a wiring diagram for the compactor system.

With reference to FIG. 4, a schematic diagram of the electrical circuit utilized in the compaction device of the present invention is illustrated. Power is supplied to the compactor unit through electrical plug 100, the high side of the power being connected to terminal 1 of terminal block 102 and the low side to terminal 10 of terminal block 102. The high side voltage from terminal 1 of terminal block 102 passes through door switch 104 to terminal 2 of terminal block 102. Door switch 104 is operated by the trash access door 14 at the bottom of the compactor unit through which the compactor trash is removed. When the trash access door 14 is opened, door switch 104 is opened and removes power from pin 2 of terminal block 102, thus removing all power from the compactor unit.

Operation of the compactor unit begins when the user wishing to deposit trash in the trash disposal system steps on mat 18. This closes mat switch 19 which supplies low voltage from transformer 106 to control relay 108. Operation of the solenoid 110 and control relay 108 closes the switch between pins 1 and 2 of control relay 108 thereby supplying power to trash door motor 44. The trash door motor 44 then operates to open the trash deposit door 20 so that the user can deposit trash into the trash disposal system. The trash door 20 remains open so long as the user stands on the mat and mat switch 19 remains closed. When the user leaves the mat, mat switch 19 opens and this action turns off the solenoid 110 in control relay 108. This action, in turn, shuts off door motor 44 whereby the trash deposit door 20 is brought to a fully closed condition by the force of gravity.

Operation of control relay 108 by closure of mat switch 19 also closes the connection between pins 5 and 6 of control relay 108. At this point in the operating sequence, limit switch 114 is in the position shown in FIG. 4. Pin 1 and pin 2 of limit switch 114 are connected internally so as to supply power from pin 2 of terminal block 102 to pin 5 of control relay 108. This, in turn, supplies power to pin 6 of control relay 108 and to pin 1 of timer 80.

The voltage applied to pin 1 of timer 80 passes through to pin 3 of timer 80 which, in turn, causes the timer in timer 80 to be activated and causes the relay within the timer to shift to connect to pin 3. At this point in the operational sequence, pin 4 of timer 80 is connected to terminal 6 of terminal block 102 which, in turn, is connected to the low side of the power source connector pin 10 at terminal 2 via the connection between pin 6 and 7 of limit switch 114. After a suitable, predetermined time has passed, such as 15 seconds, for example, timer 80 "times out" and the switch within timer 80 reconnects pin 1 to pin 3. If the user is still on mat 18, voltage is still supplied to pin 1 of timer 80 so that the timer is re-energized for another 15 seconds. This cyclic re-energizing of the timer continues as long as a user is on mat 18 and switch 19 is closed.

When the user steps off mat 18, mat switch 19 opens thereby turning off the solenoid 110 and control relay 108, which, as mentioned above, turns off door motor 44 enabling the trash deposit door 20 to close. When the solenoid 110 and control relay 108 are turned off, pin 5 is connected to pin 7 of control relay 180 which feeds power to switch 118 and to pin 2 of timer 80. Switch 118 is normally closed and is only opened to inhibit or defeat automatic operation of the compactor. Power passes through pin 2 to pin 3 of timer 80, thus continuing to energize timer 80 until limit switch 114 operates to disconnect pin 6 from pin 7 thereof.

Turning off control relay 108 connects pin 3 to pin 4 of relay 108 which feeds power to terminal 4 of terminal block 102. Power from terminal 4 of terminal block 102 passes through fuse 120 to winding 122 of ram motor 34. Power is also supplied through fuse 120 to terminal 5 of terminal block 102. The connection between pins 4 and 5 of limit switch 114 supplies power from terminal 5 to terminal block 102 to start winding 124 around motor 34 which starts the ram downward to compact the trash. The voltage supplied to start winding 124 is shifted in phase relative to run winding 122 by the combination of capacitor 123 and resistor 125. As ram motor 34 reaches operating speed, centrifugal switch 126 opens, thus turning off the power to start winding 124. The ram motor then continues operation at slightly less than synchronous speed.

When ram 26 begins to operate, power is supplied to pins 1 and 2 of relay 130 and opens the connections between pins 3 and 4 thereof. This inhibits operation of control relay 108 until the compaction sequence is finished. As ram motor 34 operates, ram 26 compresses the trash in the waste disposal system. When the trash is compacted, ram 26 slows and ram motor 34 stalls which, in turn, causes centrifugal switch 126 to close. Closure of centrifugal switch 126 by any suitable mechanical connection (not shown) causes limit switch 114 to operate. The operation of switch 114 reverses the polarity of the power supply from limit switch pins 4 and 6 of limit switch 114 to start winding 124 which, in turn, causes ram 26 to reverse its direction of operation. When ram 26 reaches its operating speed, centrifugal switch 126 opens, thus interrupting power to start winding 124, ram motor 34 continuing to operate in the reverse direction in slightly less than synchronous speed. Operation of limit switch 114 closes the connection between its pins 1 and 3, thus supplying power to terminal 3 of terminal block 102 while continuing to supply power to pins 3 and 4 of control relay 108 to terminal 4 of terminal block 102 and the ram motor 34.

When the ram 26 reaches the top limit of its travel, ram motor 34 again stalls out, closing centrifugal switch 126 which, by its mechanical connection to limit switch 114, returns limit switch 114 to its original position. This opens the connection between pins 1 and 3 of switch 114 which, in turn, turns off the power to ram motor 34.

While the ram is being raised back to the top of the compactor unit, timer 80 times out since terminal 4 of timer 80, during operation of the ram motor in reverse, is connected by the limit switch 114 to the high side of the voltage supply from power plug 100. When the timer 80 is timed out and has broken the connection between its pins 2 and 3, there is no power supply to pin 3 of control relay 108. At this time, there is no source of power to operate ram motor 34 when limit switch 114 is returned from its original position thereby breaking the connection between pins 1 and 3 of limit switch 114. The removal of power from ram motor 34 also turns off relay 130 restoring the connection between its pins 3 and 4 so that control relay 108 can again be operated by closure of mat switch 19. Accordingly, the compactor has returned to its initial position and is again ready to receive trash. The control circuitry for the compactor unit can be circumvented and the ram motor 34 operate at any time by closure of key switch 88 which supplies power to ram motor 34. Operation of ram motor 34 is indicated by run light 136.

It is to be understood that the above described embodiment of the invention is illustrative only and that modifications thereof may occur to those skilled in the art. Accordingly, this invention is not to be regarded as limited to the embodiment disclosed herein, but is to be limited only as defined by the appended claims.

What is claimed is:

1. A waste disposal system for receiving and compacting trash deposited by a user comprising:

(a) a system frame having an upper and a lower portions and support means associated with the lower portion of said frame for supporting a waste container;

(b) a compactor unit having a ram means adjacent to the waste container, a guide chain attached at one end to said upper portion of said frame and at its opposite end to said lower portion of said frame, a sprocket engaging said chain rotatably mounted on said ram means, means for rotating said sprocket in either rotational direction, a chain follower mounted adjacent to said sprocket on said ram means, said follower brushing said chain on said sprocket so that upon rotation of said sprocket said ram means is moved in a compactor cycle towards and away from said support means to compact waste in the waste container on said support;

(c) a waste deposit door located in said frame for permitting access to said container on said support;

(d) switch means activated by a user; and (e) control means for automatically opening said door when said switch means is activated by a user, said control means including timer means responsive to said switch means being activated for imitating operation of the compactor unit towards said support at a predetermined time period after said switch is activated by the user.

2. The system of claim 1 including means operatively combined with said compactor unit such that when said ram means is moved towards said support to compact waste in the container on said support, locking means are placed against said door so that said door is prevented from being opened by a user.

3. The system of claim 1 further including disabling means for disabling said compactor unit from moving towards said support to compact waste in the container when said door is open.

4. The system of claim 1 further comprising: means to automatically close said door upon the activation of said switch means.

5. The system of claim 4 further comprising: safety means adapted to lock said door upon initiation of said automatic closing means and remaining locked and closed until said compactor cycle is completed.

6. The system of claim 1 further comprising: disabling means for disabling said ram mans from moving towards said support even when said switch means is activated by a user when said door is open.

7. A readily installable and removable self container trash compacting device for use in a waste disposal system having a waste container and a normally closed waste deposit door for placing waste material into the container from outside of the unit comprising:

(a) a compactor means removably installable within the waste disposal system, having a frame means, a guide chain attached at one end to an upper portion of said frame means and at its opposite end to a lower portion of said frame means, a ram means, a sprocket engaging said chain rotably attached to said ram means, a chain follower biasing said to said sprocket, means for rotating said sprocket so that upon rotation of said sprocket said ram means is moved towards and away from the waste material in the container, compacting same;

(b) mating frame means located in the disposal system adjacent to the waste deposit door for receiving and holding the compactor means as it is slid into the disposal system;

(c) sensor means for sensing when trash is to be placed in said door from outside the waste disposal system by a user of the disposal system and initiating the opening of the waste deposit door; and (d) safety control means for inhibiting the cycling of the trash compactor means when the waste deposit door is open.

* * * * *